US011300917B2

(12) United States Patent
Kuroki

(10) Patent No.: US 11,300,917 B2
(45) Date of Patent: Apr. 12, 2022

(54) IMAGE FORMING APPARATUS

(71) Applicant: CANON KABUSHIKI KAISHA, Tokyo (JP)

(72) Inventor: Tooru Kuroki, Tsukuba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/896,449

(22) Filed: Jun. 9, 2020

(65) Prior Publication Data

US 2020/0409301 A1 Dec. 31, 2020

(30) Foreign Application Priority Data

Jun. 26, 2019 (JP) ..... JP2019-118654

(51) Int. Cl.
*G03G 15/00* (2006.01)
*H01R 13/15* (2006.01)
(Continued)

(52) U.S. Cl.
CPC ..... *G03G 15/80* (2013.01); *H01R 12/716* (2013.01); *H01R 13/15* (2013.01); *H01R 2107/00* (2013.01); *H01R 2201/06* (2013.01)

(58) Field of Classification Search
CPC .. G03G 15/80; G03G 21/1619; H01R 12/716; H01R 13/15; H01R 2107/00; H01R 12/91; H01R 2201/06
See application file for complete search history.

(56) References Cited

U.S. PATENT DOCUMENTS 9,110,428 B2 * 8/2015 Imoto ..... G03G 15/80
2004/0238199 A1 * 12/2004 Yamanaka ..... G03G 21/1652 174/68.1

(Continued)

FOREIGN PATENT DOCUMENTS

JP 2006-154076 6/2006

OTHER PUBLICATIONS

U.S. Appl. No. 16/925,525, filed Jul. 10, 2020 by Tooru Kuroki.

*Primary Examiner* — Abdullah A Riyami
*Assistant Examiner* — Nader J Alhawamdeh
(74) *Attorney, Agent, or Firm* — Venable LLP

(57) ABSTRACT

Provided is an image forming apparatus including:
a first circuit board;
a second circuit board which is electrically connected to the first circuit board via a cable;
a board-side connector which is mounted on the first circuit board, is connected to a cable-side connector of the cable, the board-side connector including a plurality of terminals extending in a first direction orthogonal to a mounting surface of the first circuit board and arranged in parallel in a second direction orthogonal to the first direction, and a housing in which the plurality of terminals is housed, the housing having a first wall arranged on one side of the plurality of terminals in a third direction orthogonal to the first direction and the second direction, and having a portion of which a length in the first direction is larger than a length of each of the plurality of terminals in the first direction, the portion facing the plurality of terminals, the housing having a second wall arranged on the other side of the plurality of terminals and having a portion of which at least a part has a length in the first direction smaller than the length of each of the plurality of terminals in the first direction, the portion facing the plurality of terminals; and (Continued)

a restricting member configured to restrict an insertion angle of the cable-side connector with respect to the board-side connector, the restricting member being arranged adjacent to the second wall of the board-side connector in the third direction, a length of the restricting member in the first direction being larger than the length of each of the plurality of terminals in the first direction, wherein $L3 \leq (L2 - L1)/\tan 65°$ is satisfied when the length of each of the plurality of terminals in the first direction is L1, the length of the restricting member in the first direction is L2, a distance between the plurality of terminals and the restricting member in the third direction is L3, and $L2 \leq 50$ mm.

11 Claims, 10 Drawing Sheets

(51) Int. Cl.
*H01R 12/71* (2011.01)
*H01R 107/00* (2006.01)

(56) References Cited

U.S. PATENT DOCUMENTS

2007/0009280 A1* 1/2007 Kubo ..... G03G 15/80 399/88
2013/0122741 A1* 5/2013 Imoto ..... H02G 15/18 439/535
2020/0409301 A1* 12/2020 Kuroki ..... H01R 12/91

* cited by examiner

| RECEPTACLE CONNECTOR NO. | NUMBER OF ENGAGEMENT HOLES | DIMENSION IN LONGITUDINAL DIRECTION (mm) | NUMBER OF PINS OF PIN TERMINAL |
|---|---|---|---|
| 300 | 2 | 26 | 19 |
| 301 | 1 | 11 | 7 |
| 302 | 1 | 8 | 5 |
| 303 | 2 | 21 | 15 |
| 304 | 1 | 13 | 9 |
| 305 | 2 | 34 | 25 |

IMAGE FORMING APPARATUS

BACKGROUND OF THE INVENTION

Field of the Invention

The present invention relates to an image forming apparatus such as an electrophotographic copying machine and an electrophotographic printer (for example, a laser beam printer or an LED printer).

Description of the Related Art

For example, an image forming apparatus having a configuration, in which an electronic board (circuit board) such as a controller board or a power supply board are electrically connected with a cable via a connector, disclosed in Japanese Patent Laid-Open No. 2006-154076 has been widely known.

In a case where a board-side connector is mounted on the electronic board, a terminal of the board-side connector is generally provided so as to extend in a direction orthogonal to a mounting surface of the electronic board. When a cable-side connector is inserted into such a board-side connector obliquely with respect to the direction orthogonal to the mounting surface of the electronic board, the terminal of the board-side connector and the cable-side connector interfere with each other. In this case, a force in an unintended direction may be applied to the terminal of the board-side connector, such that the terminal is deformed, and the electrical connection between the board-side connector and the cable-side connector may not be properly made.

SUMMARY OF THE INVENTION

It is desirable to provide an image forming apparatus capable of restricting an insertion angle of a cable-side connector with respect to a board-side connector.

According to a representative configuration of the present invention, an image forming apparatus includes: a first circuit board which is arranged on a rear side of the image forming apparatus; a second circuit board which is electrically connected to the first circuit board via a cable; a board-side connector which is mounted on the first circuit board, is connected to a cable-side connector of the cable, the board-side connector including a plurality of terminals extending in a first direction orthogonal to a mounting surface of the first circuit board and arranged in parallel in a second direction orthogonal to the first direction, and a housing in which the plurality of terminals is housed, the housing having a first wall arranged on one side of the plurality of terminals in a third direction orthogonal to the first direction and the second direction, and having a portion of which a length in the first direction is larger than a length of each of the plurality of terminals in the first direction, the portion facing the plurality of terminals, the housing having a second wall arranged on the other side of the plurality of terminals and having a portion of which at least a part has a length in the first direction smaller than the length of each of the plurality of terminals in the first direction, the portion facing the plurality of terminals; and a restricting member configured to restrict an insertion angle of the cable-side connector with respect to the board-side connector, the restricting member being arranged adjacent to the second wall of the board-side connector in the third direction, a length of the restricting member in the first direction being larger than the length of each of the plurality of terminals in the first direction, wherein $L3 \leq (L2-L1)/\tan 65°$ is satisfied when the length of each of the plurality of terminals in the first direction is L1, the length of the restricting member in the first direction is L2, a distance between the plurality of terminals and the restricting member in the third direction is L3, and $L2 \leq 50$ mm.

Further features of the present invention will become apparent from the following description of exemplary embodiments with reference to the attached drawings.

DESCRIPTION OF THE EMBODIMENTS

First Embodiment

<Image Forming Apparatus>

Hereinafter, an overall configuration of an image forming apparatus according to a first embodiment of the present invention will be described together with an operation at the time of image formation with reference to the drawings. Note that the dimensions, materials, shapes, relative arrangements, and the like of components described below are not intended to limit the scope of the present invention unless otherwise specified.

An image forming apparatus A according to the present embodiment is an intermediate tandem type image forming apparatus in which four color toners of yellow Y, magenta M, cyan C, and black K are transferred to an intermediate transfer belt, and then an image is transferred to a sheet to form an image. In the following description, although members using the toners of the respective colors are given suffixes of Y, M, C, and K, configurations or operations of the respective members are substantially the same as each other except that the color of the toner used is different, and thus the suffixes are omitted as appropriate unless necessary to distinguish the members from each other.

Figure 1:
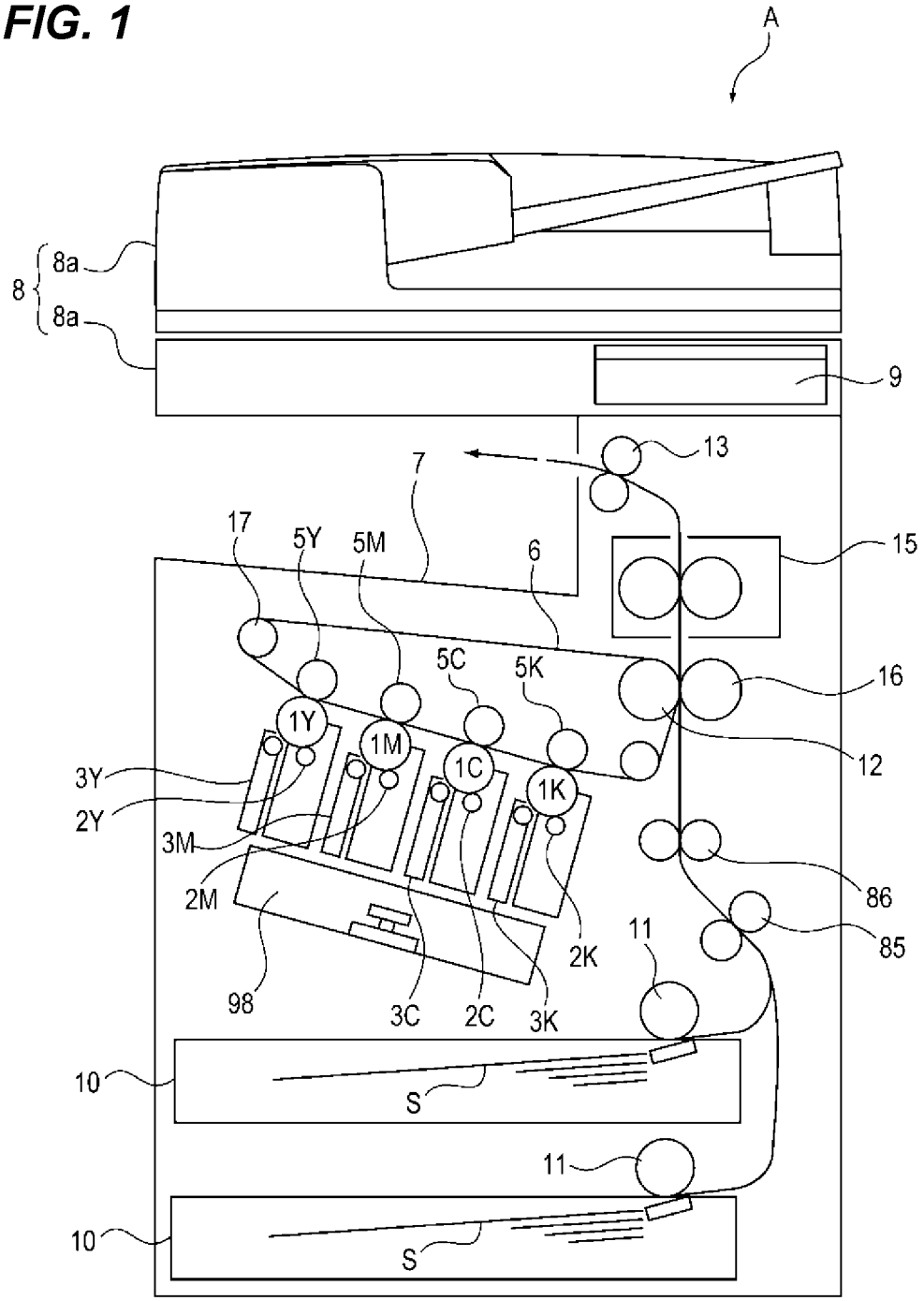
FIG. 1 is a schematic cross-sectional view of an image forming apparatus.

FIG. 1 is a schematic cross-sectional view of the image forming apparatus A. As illustrated in FIG. 1, the image forming apparatus A includes an image forming portion which transfers a toner image to a sheet S to form an image.

The image forming portion includes photosensitive drums 1 (1Y, 1M, 1C, and 1K), charging rollers 2 (2Y, 2M, 2C, and 2K), and developing devices 3 (3Y, 3M, 3C, and 3K). Further, the image forming portion includes primary transfer rollers 5 (5Y, 5M, 5C, and 5K), a laser scanner unit 98, an intermediate transfer belt 6, a secondary transfer roller 16, a secondary transfer counter roller 12, a drive roller 17, and the like.

Further, an operation portion 9 which can be operated to perform setting related to image formation is provided on a front side (front surface side) of the image forming apparatus A. The operation portion 9 includes a display portion (display screen) which displays information, a numeric keypad for inputting numerical values, a clear key for canceling an input by the numeric keypad, a start key for performing image formation, a stop key for stopping the image formation, and the like. Instead of the numeric keypad, the clear key, the start key, and the stop key as hard keys, an operation portion which displays a numeric keypad, a clear key, a start key, and a stop key as soft keys on a touch panel display portion may be provided in the image forming apparatus A. A user can operate the numeric keypad to input a numerical value or the like to thereby perform setting related to image formation, such as setting of a type of the sheet S, an output size of an image, and the number of images to be formed. Here, the front side of the image forming apparatus A is a side on which the user usually stands to operate the operation portion 9. A rear side of the image forming apparatus A is, for example, a side opposite to the front side with a metal or resin frame interposed therebetween, the metal or resin frame supporting the image forming portion. A left side of the image forming apparatus A is the left side as viewed from the front side, and a right side of the image forming apparatus A is the right side as viewed from the front side.

An image reading portion 8 which reads an image of an original is provided at an upper portion of the image forming apparatus A. The image reading portion 8 includes a reader 8*a* and an auto document feeder (ADF) 8*b*. The reader 8*a* optically reads an image of an original placed on a reading surface (not illustrated) formed using a glass plate and converts the image into image data. The ADF 8*b* automatically conveys the original loaded on an original tray and reads the image. The ADF 8*b* is rotatably supported, and the reading surface of the reader 8*a* can be accessed by rotating the ADF 8*b* to open the ADF 8*b* upward.

Next, an image forming operation performed by the image forming apparatus A will be described. When forming an image, first, an image forming job signal is input to a controller (not illustrated). Then, a feed roller 11 and conveying rollers 85 rotate, and the sheet S loaded and stored in a sheet cassette 10 is conveyed to registration rollers 86. Next, the sheet S is conveyed by the registration rollers 86 to a secondary transfer portion including the secondary transfer roller 16 and the secondary transfer counter roller 12, at a predetermined timing.

Meanwhile, in the image forming portion, first, a surface of the photosensitive drum 1Y is charged by the charging roller 2Y. Thereafter, the laser scanner unit 98 irradiates the surface of the photosensitive drum 1Y with a laser beam according to a drive signal generated based on the image of the original read by the image reading portion 8 to form an electrostatic latent image on the surface of the photosensitive drum 1Y. Then, a yellow toner is attached to the electrostatic latent image formed on the surface of the photosensitive drum 1Y by the developing device 3Y to form a yellow toner image on the surface of the photosensitive drum 1Y. As a primary transfer bias is applied to the primary transfer roller 5Y, the toner image formed on the surface of the photosensitive drum 1Y is primarily transferred to the intermediate transfer belt 6.

Through the same process, magenta, cyan, and black toner images are formed on the photosensitive drums 1M, 1C, and 1K, respectively. Then, as a primary transfer bias is applied to the primary transfer rollers 5M, 5C, and 5K, these toner images are overlappingly transferred onto the yellow toner image on the intermediate transfer belt 6. As a result, a full-color toner image corresponding to an image signal is formed on a surface of the intermediate transfer belt 6.

Thereafter, the intermediate transfer belt 6 is rotationally moved by a driving force transmitted from the drive roller 17, such that the full-color toner image is sent to the secondary transfer portion. As a secondary transfer bias is applied to the secondary transfer roller 16 in the secondary transfer portion, the full-color toner image on the intermediate transfer belt 6 is transferred to the sheet S.

Next, the sheet S to which the toner image is transferred is subjected to heating and pressurizing processing in a fixing device 15, whereby the toner image on the sheet S is fixed to the sheet S. Then, the sheet S to which the toner image is fixed is discharged to a discharge portion 7 by a discharge roller 13.

<Control Board>

Next, a control board mounted on the image forming apparatus A will be described.

Figure 2:
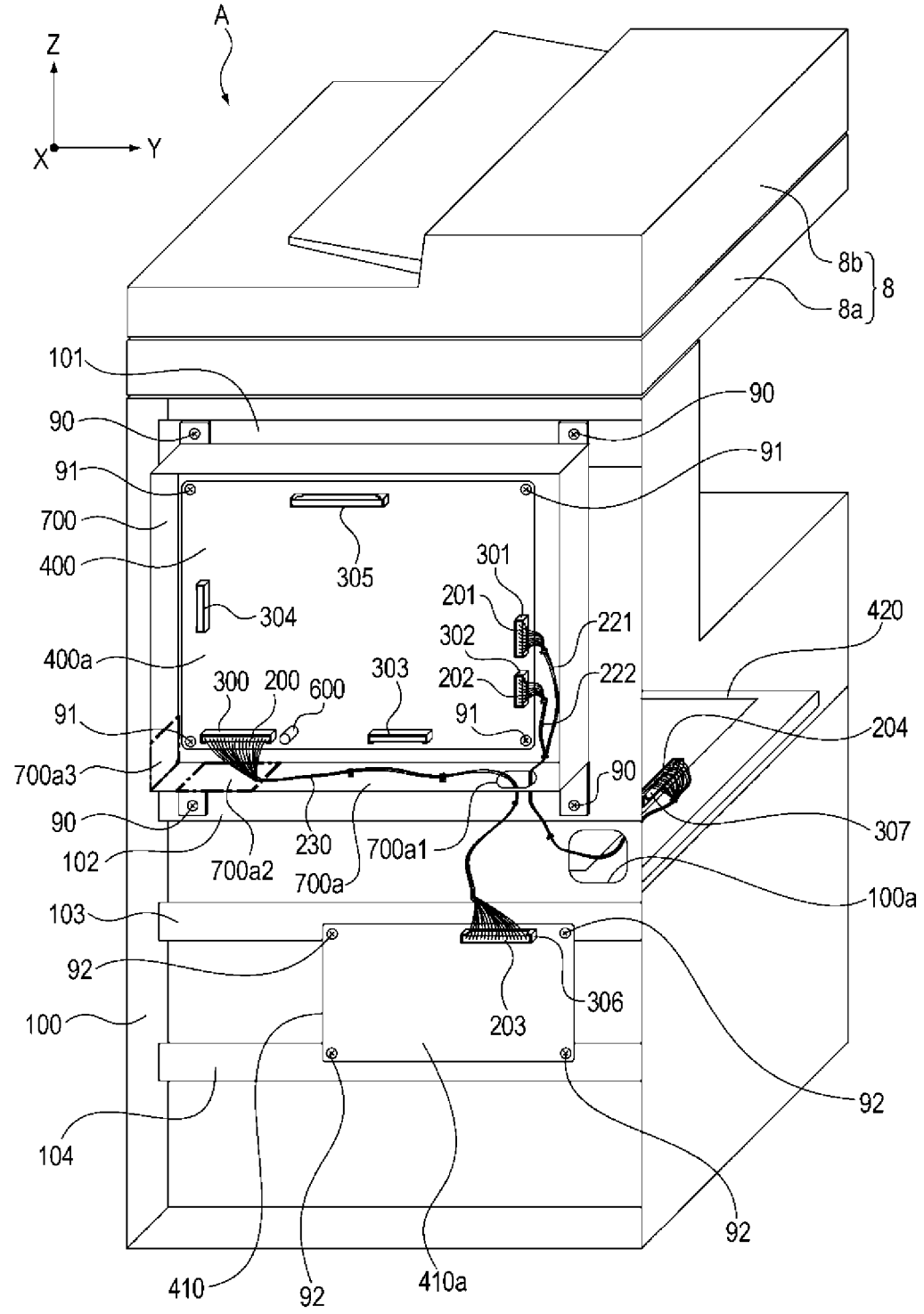
FIG. 2 is a schematic perspective view of the image forming apparatus.

FIG. 2 is a schematic perspective view of the image forming apparatus A as viewed from the rear side. In FIG. 2, exterior covers on a rear surface and a left side surface of the image forming apparatus A are omitted to show an internal configuration of the image forming apparatus A. As illustrated in FIG. 2, stays 101, 102, 103, and 104 for reinforcing a rear plate 100 are provided on the rear plate 100, which is a frame of the image forming apparatus A. The rear plate 100 or the stays 101 to 104 are frames on the rear side of the image forming apparatus A, which are arranged on the rear side of the image forming apparatus A and behind the image forming portion such as the photosensitive drums 1.

A metal electrical component box 700 (housing member) is fixed to the stays 101 and 102 by screws 90. In FIG. 2, a metal lid of the electrical component box 700 is omitted to show an internal configuration of the electrical component box 700. A first circuit board 400 is housed in the electrical component box 700. The first circuit board 400 is fixed to the electrical component box 700 by screws 91. In other words, the first circuit board 400 is fixed to the frame on the rear side of the image forming apparatus A via the electrical component box 700, and is housed and shielded in the metal electrical component box 700 in order to minimize the influence of external noise on the following image processing, and to block radiation noise that can be radiated to the outside due to the following image processing or the like, as much as possible. The electrical component box 700 of the present embodiment is a box formed by bending one sheet metal (steel plate). Portions bent and erected from a mounting surface on which the first circuit board 400 is mounted by the screws 91 form side walls of the electrical component box. A lid (cover member) that covers the first circuit board 400 may be attached to the electrical component box 700.

The first circuit board 400 is a controller board provided in the image forming apparatus A to control a power supply board 420, process image data (image processing), perform communication with an external device such as a personal computer (PC), a tablet PC, or a smartphone. Image processing of converting an image of an original read by the image reading portion 8 into image data is performed in the first circuit board 400. Further, image processing of generating image data based on an image input from an external device is performed in the first circuit board 400. The image processing includes processing of converting RGB into YMCK, density correction, magnification correction, color shift correction processing, and the like. Further, in the first circuit board 400, the image data is converted into the drive signal. In order to implement the above-described functions, a number of electronic components including a controller IC, the electrolytic capacitor 600, and an application specific integrated circuit (ASIC) are mounted on a mounting surface 400*a* of the first circuit board 400. Further, a total of six receptacle connectors 300 to 305 (board-side connectors) are mounted on the first circuit board 400.

A second circuit board 410 is fixed to the stays 103 and 104 located below the electrical component box 700 by screws 92. The second circuit board 410 is an engine board provided in the image forming apparatus A to control a motor (not illustrated) for driving a roller for conveying the sheet S, or other driving systems. Examples of a driving target in other driving systems include the charging rollers 2 (2Y, 2M, 2C, and 2K), developing rollers included in the developing devices 3 (3Y, 3M, 3C, and 3K), and the primary transfer rollers 5 (5Y, 5M, 5C, and 5K). In addition, examples of the driving target in other drive systems also include a drive motor for rotating a rotary polygon mirror included in the laser scanner unit 98, the intermediate transfer belt 6, the secondary transfer roller 16, and the secondary transfer counter roller 12. In order to implement the above-described functions, a number of electronic components including a controller IC and an ASIC are mounted on a mounting surface 410*a* of the second circuit board 410. A receptacle connector 306 (board-side connector) is mounted on the mounting surface 410*a* of the second circuit board 410.

The first circuit board 400 and the second circuit board 410 are electrically connected by a cable 230, and both are configured to be communicable. An electric signal for notifying a timing to start or stop the driving of the driving system is transmitted from the first circuit board 400 to the second circuit board 410 via the cable 230. The cable 230 is routed from the first circuit board 400 to the second circuit board 410 through an opening portion 700*a*1 formed in a wall 700*a* of the electrical component box 700. A plug connector 200 (cable-side connector) connected to the receptacle connector 300 mounted on the first circuit board 400 is attached to one end portion of the cable 230. A plug connector 203 (cable-side connector) connected to the receptacle connector 306 mounted on the second circuit board 410 is attached to the other end portion of the cable 230.

Further, the power supply board 420 is provided in front of the rear plate 100 in the image forming apparatus A. The power supply board 420 is provided in the image forming apparatus A to supply power to each unit (the image forming portion, the fixing device, a driving source of the rollers for conveying a sheet, and the image reading portion) of the image forming apparatus A. The first circuit board 400 and the power supply board 420 are electrically connected by cables 221 and 222. Power for operating the first circuit board 400 is transmitted from the power supply board 420 to the first circuit board 400 via the cable 221. A power supply control signal is transmitted from the first circuit board 400 to the power supply board 420 via the cable 222. The cables 221 and 222 are routed from the first circuit board 400 to the power supply board 420 through the opening portion 700*a*1 formed in the electrical component box 700 and an opening portion 100*a* formed in the rear plate 100. Plug connectors 201 and 202 connected to the receptacle connectors 301 and 302 mounted on the first circuit board 400, respectively, are attached to one end portions of the cables 221 and 222, respectively. A plug connector 204 connected to a receptacle connector 307 mounted on the power supply board 420 is attached to the other end portions of the cables 221 and 222.

Note that plug connectors (not illustrated) attached to end portions of cables (not illustrated) are connected to the receptacle connectors 303 to 305 mounted on the first circuit board 400, respectively, similarly to the receptacle connectors 300 to 302 and the like. The receptacle connector 303 is a connector to which a cable for performing communication with the image reading portion 8 or the operation portion 9 is connected. The receptacle connector 304 is a connector to which a cable for performing communication with a fax unit for sending and receiving faxes is connected, the fax unit being optionally mounted on the image forming apparatus A. The receptacle connector 305 is a connector to which a cable for performing communication with a Bluetooth (registered trademark) device or near field communication (NFC) device which is optionally mounted on the image forming apparatus A is connected. As such, the electrical connection between the first circuit board 400 and the other units described above is made via the cables.

<Plug Connector and Receptacle Connector>

Next, configurations of the plug connector and the receptacle connector will be described. The plug connectors 200 to 204 are the same type of connectors, and have the same configuration except for the number of terminal pins and dimensions. The receptacle connectors 300 to 307 are the same type of connectors, and have the same configuration except for the number of terminal pins and dimensions. Therefore, configurations of the plug connector 200 and the receptacle connector 300 will be described below.

Figure 3:
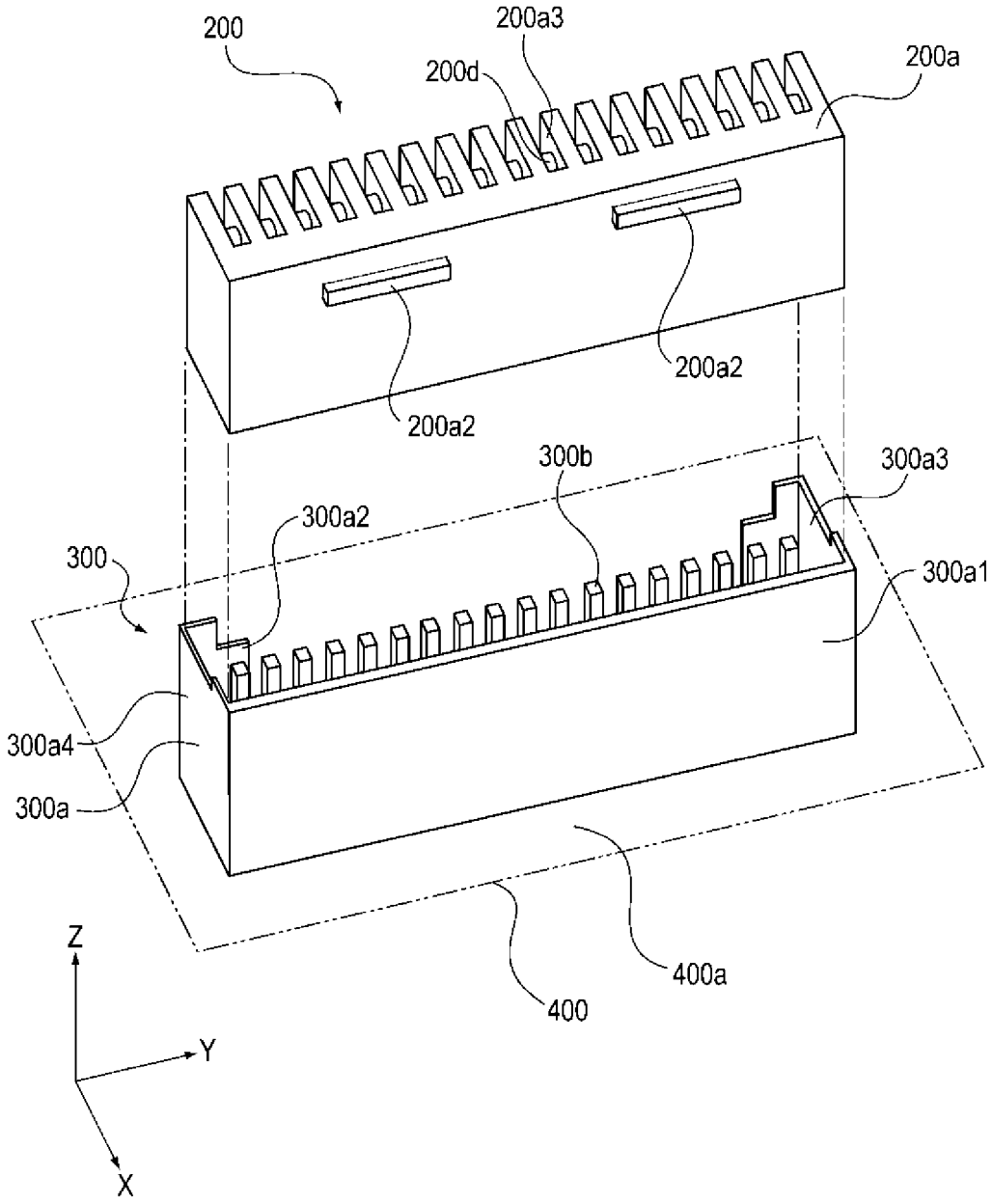
FIG. 3 is a perspective view illustrating a plug connector and a receptacle connector.
Figures 4A, 4B, 4C, 4D:
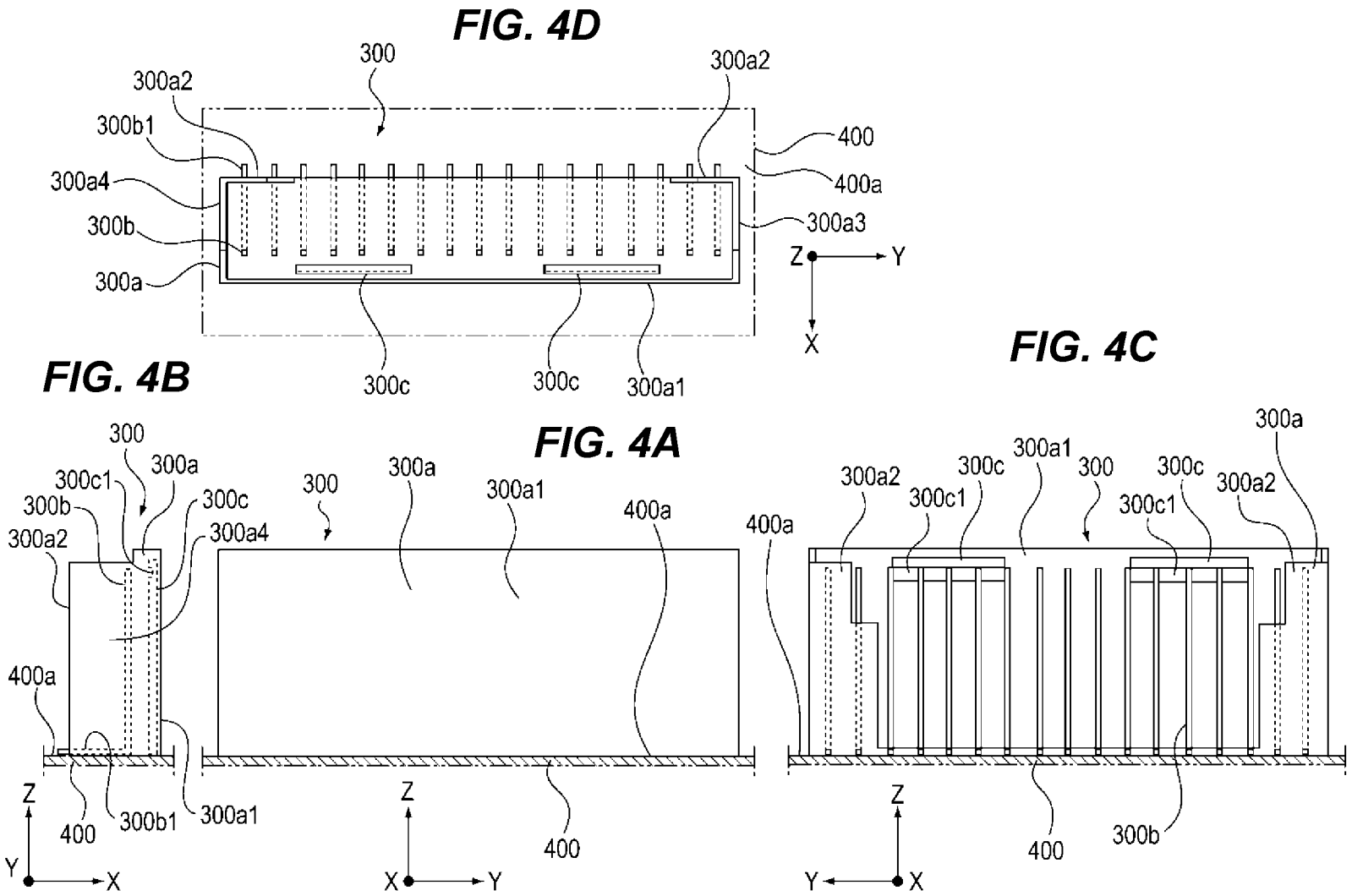
FIGS. 4A to 4D are a front view, a side view, a rear view, and a top view of the receptacle connector, respectively.
Figure 5C:
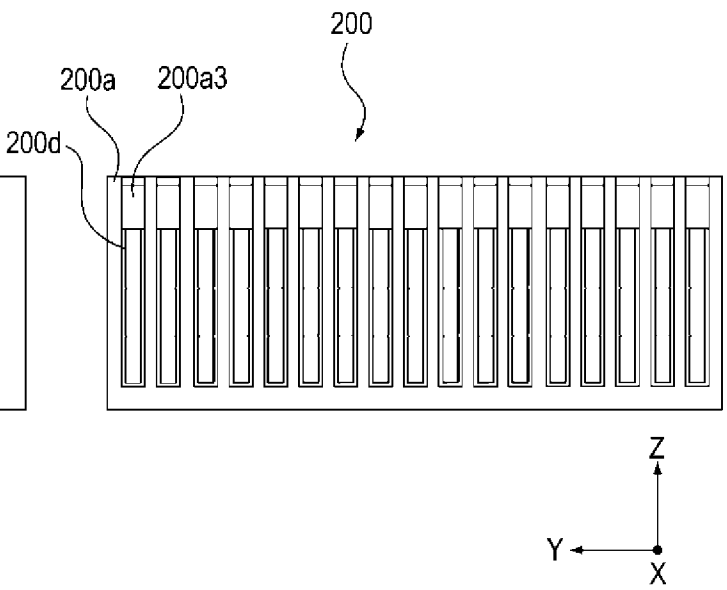
FIGS. 5A to 5D are a front view, a side view, a rear view, and a bottom view of the plug connector, respectively.
Figure 5A:
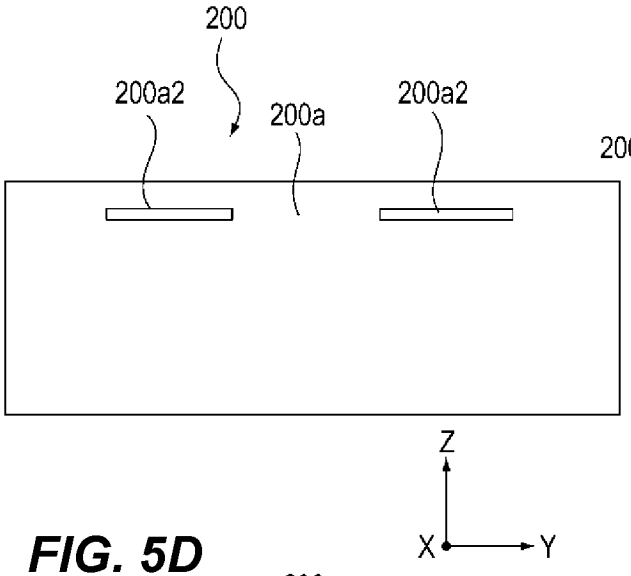
Figure 5B:
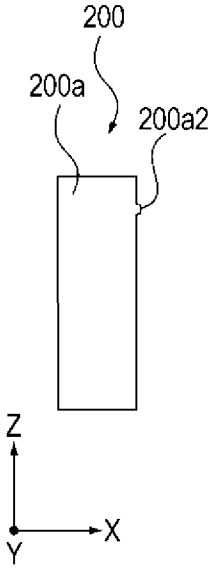
Figure 5D:
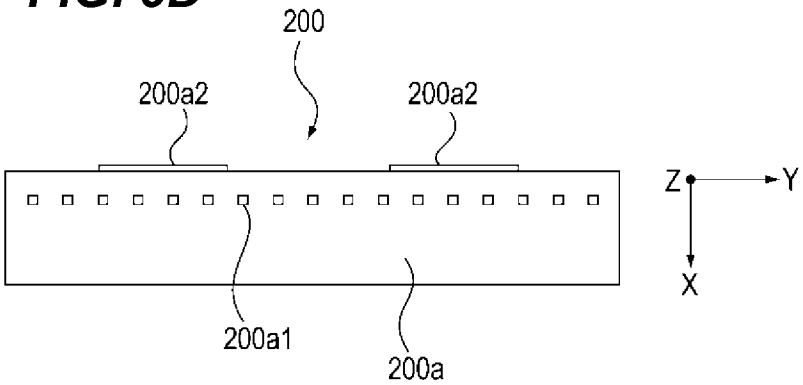

FIG. 3 is a perspective view illustrating the plug connector 200 and the receptacle connector 300. FIGS. 4A to 4D are each a view illustrating the receptacle connector 300. FIG. 4A is a front view of the receptacle connector 300, FIG. 4B is a side view of the receptacle connector 300, FIG. 4C is a rear view of the receptacle connector 300, and FIG. 4D is a top view of the receptacle connector 300. FIGS. 5A to 5D are each a view illustrating the plug connector 200. FIG. 5A is a front view of the plug connector 200, FIG. 5B is a side view of the plug connector 200, FIG. 5C is a rear view of the plug connector 200, and FIG. 5D is a bottom view of the plug connector 200.

As illustrated in FIGS. 3 and 4A to 4D, the receptacle connector 300 includes a pin terminal 300*b* which is an electrical contact portion. The pin terminal 300*b* includes 17 pins arranged at equal intervals in parallel with each other and extending in a direction (first direction) of Arrow Z orthogonal to the mounting surface 400*a* of the first circuit board 400. Lengths of the pins of the pin terminal 300*b* in the direction of arrow Z are the same. One end portion 300*b*1 of the pin terminal 300*b* is bent along the mounting surface 400*a* of the first circuit board 400, and is soldered to a conductor pattern (land pattern) (not illustrated) formed on the first circuit board 400.

The receptacle connector 300 includes a locking plate 300*c* extending in the direction of Arrow Z. The locking plate 300*c* has an engagement hole 300*c*1 that is recessed in a direction (third direction) of Arrow X orthogonal to a direction (second direction) of Arrow Y which is a lateral direction of the pin terminal 300*b*, and the direction of Arrow Z.

The pin terminal 300*b* and the locking plate 300*c* are housed in a housing 300*a*. The housing 300*a* has a wall 300*a*1 (first wall) arranged on one side of the pin terminal 300*b* in the direction of Arrow X, and a wall 300*a*2 (second wall) arranged on the other side. The housing 300*a* has a wall 300*a*3 arranged on one side of the pin terminal 300*b* in the direction of Arrow Y and a wall 300*a*4 arranged on the other side.

A length of a portion of the wall 300*a*1 facing the pin terminal 300*b* in the direction of Arrow Z is larger than the length of the pin terminal 300*b* in the direction of Arrow Z. A length of a portion of the wall 300*a*2 facing the pin terminal 300*b* in the direction of Arrow Z is smaller than the length of the pin terminal 300*b* in the direction of Arrow Z. A part of the portion of the wall 300*a*2 facing the pin terminal 300*b* is partially cut away. A length of a portion of each of the walls 300*a*3 and 300*a*4 facing the pin terminal 300*b* in the direction of Arrow Z is larger than the length of the pin terminal 300*b* in the direction of Arrow Z.

The walls 300*a*2, 300*a*3, and 300*a*4 each have a portion that is shorter than the wall 300*a*1 and longer than the pin terminal 300*b* in the direction of Arrow Z. When the plug connector 200 is connected to the receptacle connector 300, a housing 200*a* of the plug connector 200 is partially exposed from these portions. An operator performing maintenance can easily pull out the plug connector 200 from the receptacle connector 300 by gripping the exposed portion of the plug connector 200.

As illustrated in FIGS. 3 and 5C, a cable housing hole 200*a*3 is formed in the housing 200*a* of the plug connector 200. A terminal 200*d* having a projection portion 200*d*1 (FIGS. 6A and 6B) is provided near the cable housing hole 200*a*3. An operator performing assembly houses the cable 230 (FIGS. 6A and 6B) in the cable housing hole 200*a*3, and causes the projection portion 200*d*1 of the terminal 200*d* to bite into an insulating sheath of the housed cable 230 by using a tool. As a result, the projection portion 200*d*1 of the terminal 200*d* comes into contact with a conductive wire inside the insulating sheath of the cable 230 and is electrically connected thereto.

In addition, a through hole 200*a*1 that penetrates a bottom surface of the housing 200*a* in the direction of Arrow Z is formed in the bottom surface of the housing 200*a* of the plug connector 200. When the plug connector 200 is inserted into the receptacle connector 300, the pin terminal 300*b* of the receptacle connector 300 enters into the through hole 200*a*1. As a result, movement of the plug connector 200 in the direction of Arrow Z is guided by the pin terminal 300*b*. Once the plug connector 200 is inserted, the pin terminal 300*b* and the terminal 200*d* come into contact with each other, and the receptacle connector 300 and the plug connector 200 are electrically connected.

A protrusion portion 200*a*2 (engaging portion) protruding in the direction of Arrow X is formed on an outer surface of the housing 200*a* of the plug connector 200. The protrusion portion 200*a*2 engages with the engagement hole 300*c*1 (engaged portion) formed in the locking plate 300*c* of the receptacle connector 300. Accordingly, movement of the plug connector 200 connected to the receptacle connector 300 in the direction of Arrow Z is restricted, such that displacement of the plug connector 200 with respect to the receptacle connector 300 is suppressed, and a stable electrical connection between the plug connector 200 and the receptacle connector 300 is implemented. Further, since the protrusion portion 200*a*2 engages with the engagement hole 300*c*1 with a click, the operator can confirm that the plug connector 200 is inserted.

<Issues in Insertion and Removal of Plug Connector>

Next, issues in insertion and removal of the plug connector 200 with respect to the receptacle connector 300 will be described.

Figure 6B:
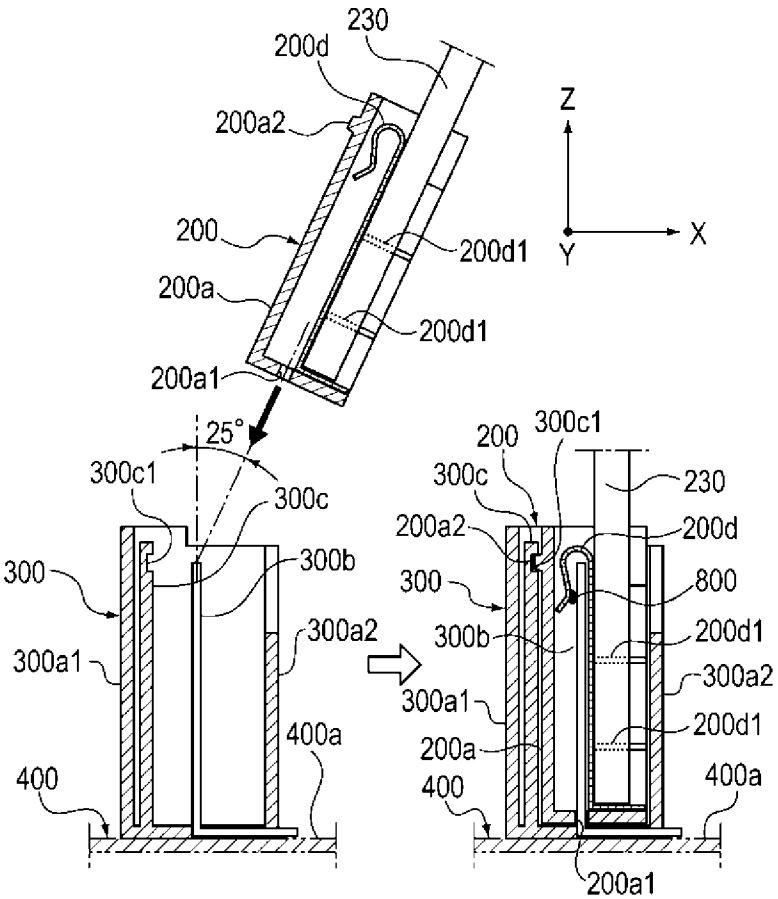
FIGS. 6A and 6B are each a schematic view illustrating a state where the plug connector is inserted into the receptacle connector.
Figure 6A:
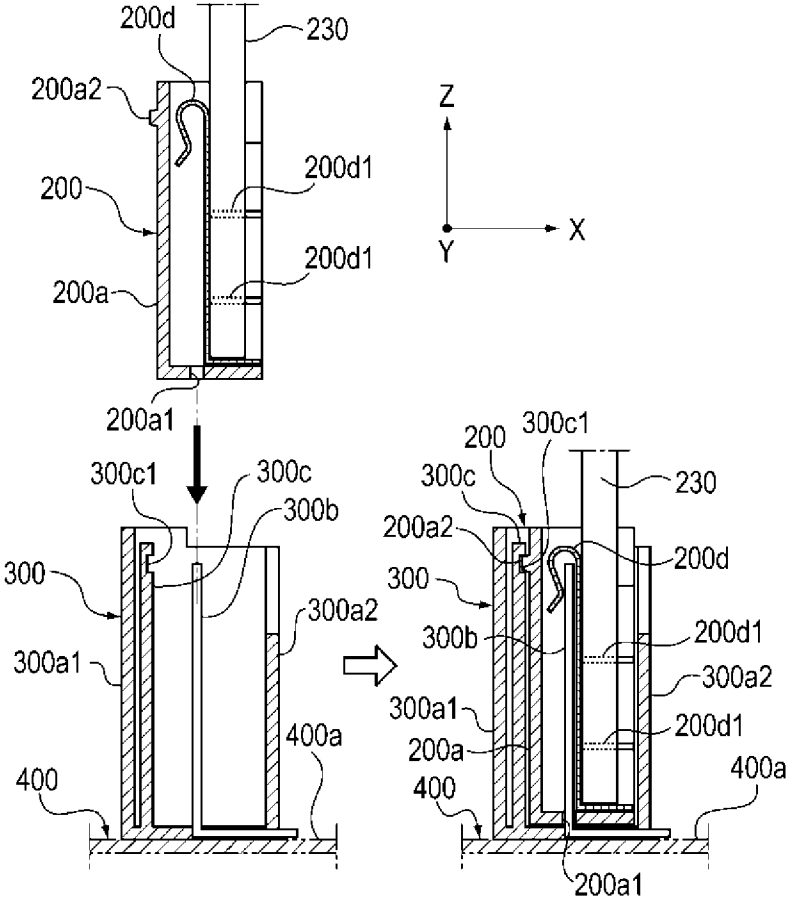
Figure 7B:
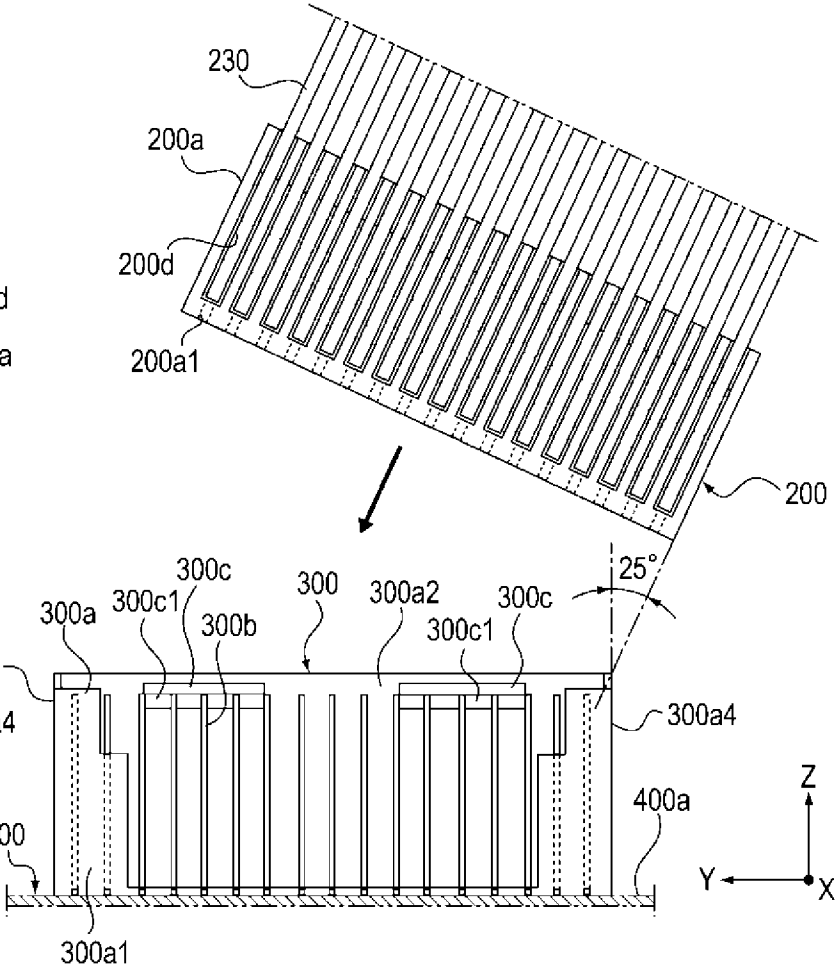
FIGS. 7A and 7B are each a schematic view illustrating a state where the plug connector is inserted into the receptacle connector.
Figure 7A:
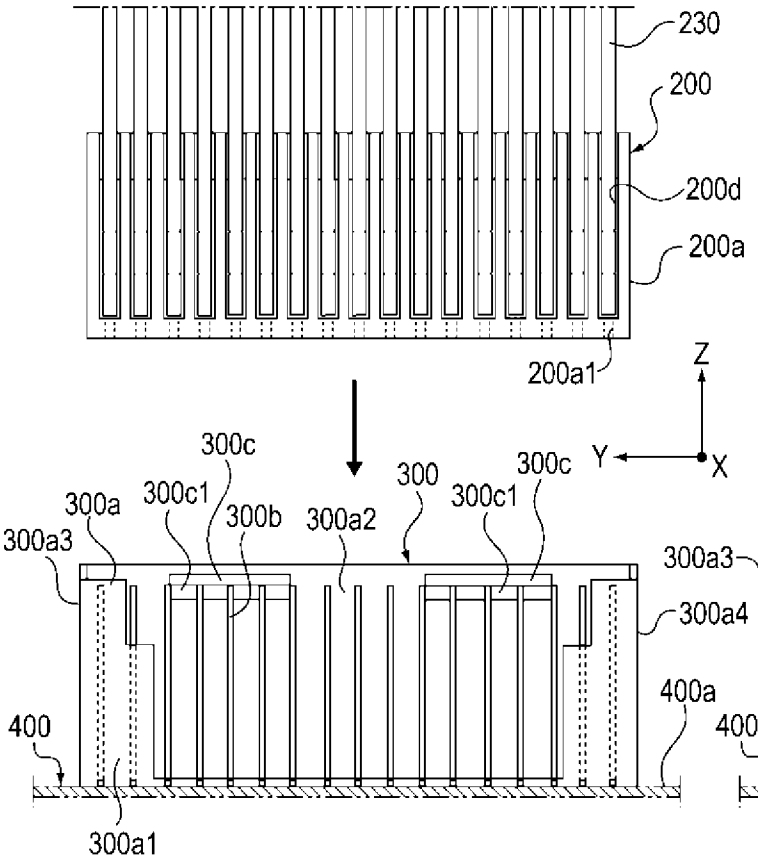

FIGS. 6A and 6B are each a schematic view illustrating a state where the plug connector 200 is inserted into the receptacle connector 300, as viewed from the direction of Arrow Y. FIGS. 7A and 7B are each a schematic view illustrating a state where the plug connector 200 is inserted into the receptacle connector 300, as viewed from the direction of Arrow X. Here, FIGS. 6A and 7A illustrate a state where the plug connector 200 is inserted in the direction of Arrow Z. FIG. 6B illustrates a state where the plug connector 200 is inserted in a direction inclined at 25° toward the direction of Arrow X with respect to the direction of Arrow Z. FIG. 7B illustrates a state where the plug connector 200 is inserted in a direction inclined at 25° toward the direction of Arrow Y with respect to the direction of Arrow Z.

As illustrated in FIGS. 6A and 7A, when the plug connector 200 is inserted in the direction of Arrow Z, since the plug connector 200 is inserted in a direction in which the pin terminal 300*b* of the receptacle connector 300 extends, an inner wall of the through hole 200*a*1 of the plug connector 200 does not interfere with the pin terminal 300*b*. Therefore, no force is applied from the plug connector 200 to the pin terminal 300*b* in an unintended direction, and the pin terminal 300*b* is not deformed. As a result, the pin terminal 300*b* and the terminal 200*d* stably come into contact with each other, and a stable electrical connection between the plug connector 200 and the receptacle connector 300 is implemented.

In a case where the plug connector 200 is inserted obliquely from the direction of Arrow X as illustrated in FIG. 6B, the pin terminal 300*b* of the receptacle connector 300 interferes with the inner wall of the through hole 200*a*1 of the plug connector 200. Similarly, in a case where the plug connector 200 is inserted obliquely from the direction of Arrow Y as illustrated in FIG. 7B, the pin terminal 300*b* of the receptacle connector 300 interferes with the inner wall of the through hole 200*a*1 of the plug connector 200. In a case where the plug connector 200 is forcibly inserted in this state, a force is applied from the plug connector 200 to the pin terminal 300*b* in an unintended direction, and the pin terminal 300*b* is deformed. In this case, the pin terminal 300*b* of the receptacle connector 300 and the terminal 200*d* of the plug connector 200 do not properly come into contact with each other, such that the electrical connection between the pin terminal 300*b* and the terminal 200*d* may not be properly made. Similarly, in a case where the plug connector 200 is pulled out obliquely from the receptacle connector 300, the pin terminal 300*b* may be deformed.

When the plug connector 200 is inserted in a state where the pin terminal 300*b* of the receptacle connector 300 and the inner wall of the through hole 200*a*1 of the plug connector 200 interfere with each other, the plug connector 200 is scraped by the pin terminal 300*b*. In this case, powder 800 (FIG. 6B) generated due to the scraping enters between the terminal 200*d* of the plug connector 200 and the pin terminal 300*b* of the receptacle connector 300. As a result, the terminal 200*d* and the pin terminal 300*b* do not properly come into contact with each other and the electrical connection between the terminal 200*d* and the pin terminal 300*b* may not be properly made.

That is, it is desirable that the plug connector 200 is inserted and removed in the direction of Arrow Z, rather than being inserted and removed obliquely, in order to implement the stable electrical connection between the plug connector 200 and the receptacle connector 300. As described above, in the housing 300*a* of the receptacle connector 300, the length of the wall 300*a*1 in the direction of Arrow Z is longer than the length of the pin terminal 300*b* in the direction of Arrow Z, and the length of the portion of the wall 300*a*2 in the direction of Arrow Z is smaller than the length of the pin terminal 300*b* in the direction of Arrow Z. Therefore, when the plug connector 200 is inserted and removed obliquely from the direction of Arrow X, it is particularly easy to perform the insertion and removal of the plug connector 200 from a side where the wall 300*a*2 is arranged, with respect to the pin terminal 300*b*.

<Restricting Member>

The image forming apparatus A includes a restricting member which restricts an insertion angle of the plug connector 200 with respect to the receptacle connector 300. Hereinafter, a configuration of the restricting member will be described.

Figure 8:
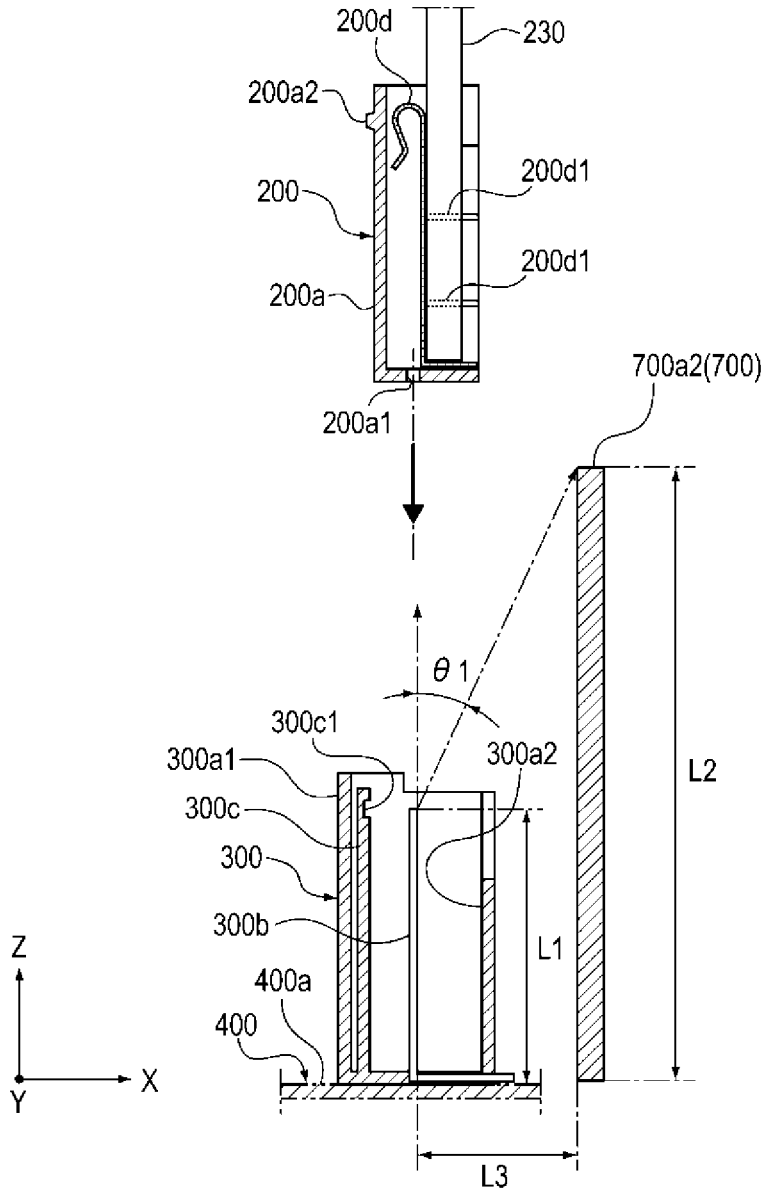
FIG. 8 is a schematic view illustrating a configuration of a restricting plate.

First, a configuration of the restricting member which restricts the plug connector 200 from being inserted obliquely from the direction of Arrow X will be described. FIG. 8 is a schematic view illustrating a configuration of a restricting plate 700*a*2 as the restricting member. Here, the restricting plate 700*a*2 is a part of the wall 700*a* on the side of the electrical component box 700 illustrated in FIG. 2. That is, in the present embodiment, the electrical component box 700 provided for noise suppression is used as the restricting member.

As illustrated in FIG. 8, the restricting plate 700*a*2 is arranged at a position adjacent to the wall 300*a*2 of the housing 300*a* of the receptacle connector 300 in the direction of Arrow X. The restricting plate 700*a*2 is configured such that a length in a direction (the direction of Arrow Z) orthogonal to the mounting surface 400*a* of the first circuit board 400 is longer than the length of the pin terminal 300*b* in the same direction.

Here, in the direction of Arrow Z, the length of the pin terminal 300*b* is L1, and the length of the restricting plate 700*a*2 is L2. Note that the length L1 of the pin terminal 300*b* here refers to a length of a portion of the pin terminal 300*b* that extends in the direction of Arrow Z and comes into contact with the terminal 200*d* of the plug connector 200. Further, a distance between the portion of the pin terminal 300*b* that extends in the direction of Arrow Z and the restricting plate 700*a*2, in the direction of Arrow X is L3. A limit angle, at which a proper electrical connection between the plug connector 200 and the receptacle connector 300 is guaranteed when the plug connector 200 is obliquely inserted into the receptacle connector 300 from the direction of Arrow X, is θ1. Here, L1, L2, L3, and θ1 satisfy the following Condition 1.

$$L3 \leq (L2-L1)/\tan(90-\theta 1)^\circ \quad \text{(Condition 1)}$$

With such a configuration, when the operator attempts to insert the plug connector 200 into the receptacle connector 300 obliquely at an angle larger than the limit angle θ1, the restricting plate 700*a*2 abuts on the plug connector 200 to hinder the insertion. Further, when the operator attempts to pull out the plug connector 200 from the receptacle connector 300 obliquely at an angle larger than the limit angle θ1, the restricting plate 700*a*2 abuts on the plug connector 200 to hinder the pulling. That is, the insertion/removal angle of the plug connector 200 with respect to the receptacle connector 300 is restricted to be in a normal range by the restricting plate 700*a*2. Therefore, the deformation of the pin terminal 300*b* of the receptacle connector 300 is suppressed, and the stable electrical connection between the plug connector 200 and the receptacle connector 300 can be made.

Here, in the present embodiment, the limit angle θ1 at the time of the insertion of the plug connector 200 is assumed to be 25°, and more preferably 15°. Further, when mounting the receptacle connector 300, the length L1 of the pin terminal 300*b* is determined in advance according to the specification. In many cases, the length of the pin terminal 300*b* satisfies 1 mm≤L1≤10 mm. Further, the length of the wall 700*a* of the electrical component box 700 is determined in advance. Considering an overall size of the image forming apparatus A, the length approximately satisfies 10 mm≤L2≤50 mm. In this case, when mounting the receptacle connector 300 or attaching the first circuit board 400 on which the receptacle connector 300 is mounted to the image forming apparatus A, the distance L3 is set so as to satisfy the following Condition 2.

$$L3 \leq (L2-L2)/\tan 65^\circ \quad \text{(Condition 2)}$$

In a case where the size of the electrical component box 700 can be selected, the length L2 of the restricting plate 700*a*2 can be set arbitrarily. Further, in a case where the distance L3 is excessively long, it is difficult to restrict the insertion angle of the plug connector 200 even in a case where the length L2 of the restricting plate 700*a*2 is long. Therefore, it is desirable that 5 mm≤L3≤25 mm. In this case, the length L2 of the restricting plate 700*a*2 is set so as to satisfy the following Condition 3.

$$L2 \geq L3 \tan 65^\circ + L1 \quad \text{(Condition 3)}$$

As such, L1, L2, and L3 are set so as to satisfy Conditions 2 and 3. As a result, even in a case where the plug connector 200 is inserted obliquely from the direction of Arrow X, the insertion angle can be suppressed to 25° or less, which is the limit angle θ1. Therefore, the deformation of the pin terminal 300*b* of the receptacle connector 300 is suppressed, and the stable electrical connection between the plug connector 200 and the receptacle connector 300 can be made.

In the present embodiment, the entire pin terminal 300*b* of the receptacle connector 300 and the restricting plate 700*a*2 overlap each other when viewed from the direction of Arrow X. However, the present invention is not limited thereto, and the above effects can be obtained as long as at least a part of the pin terminal 300*b* and the restricting plate 700*a*2 overlap each other when viewed from the direction of Arrow X.

Figure 9A:
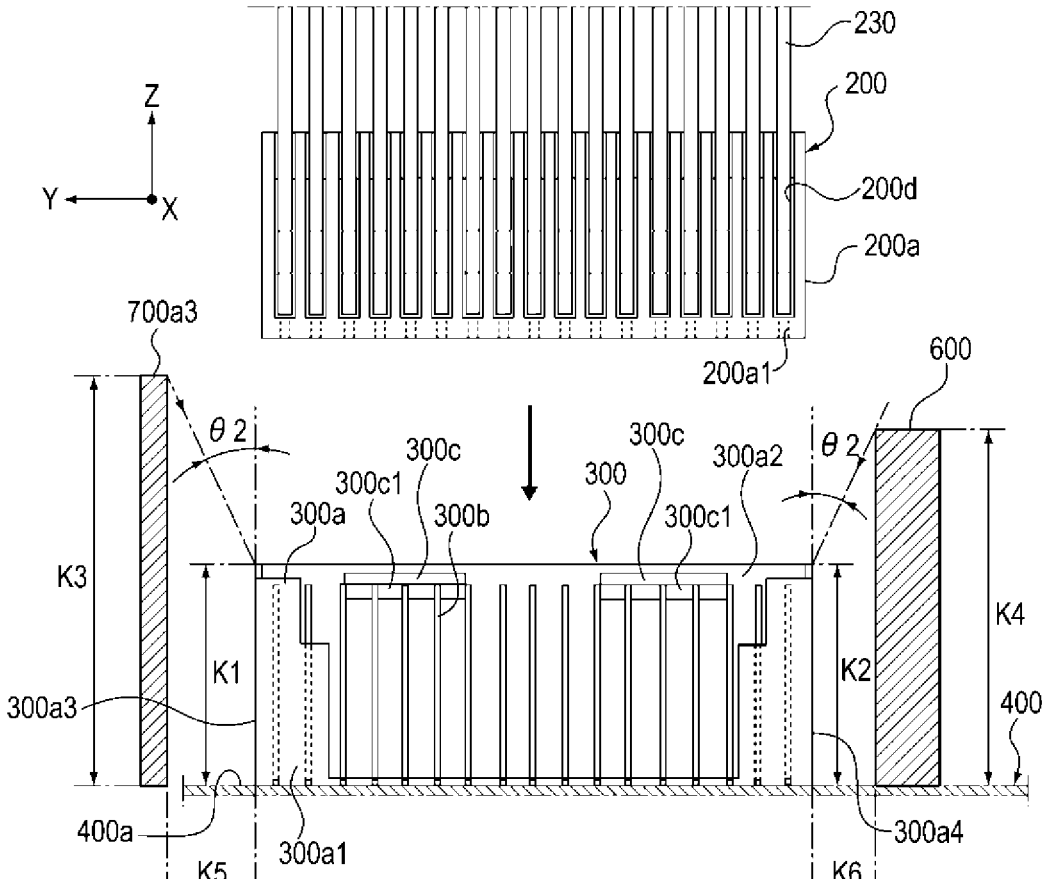
FIGS. 9A and 9B are each a schematic view illustrating configurations of the restricting plate and an electrolytic capacitor.
Figure 9B:
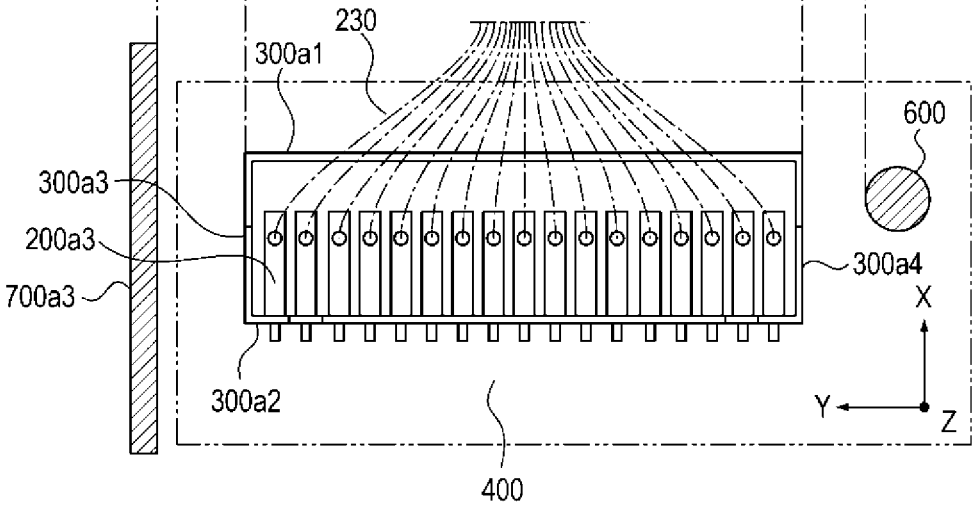

Next, a configuration of the restricting member which restricts the plug connector 200 from being inserted obliquely from the direction of Arrow Y will be described. FIGS. 9A and 9B are each a schematic view illustrating configurations of a restricting plate 700*a*3 and the electrolytic capacitor 600 as the restricting members. Here, the restricting plate 700*a*3 is a part of the wall 700*a* on the side of the electrical component box 700 illustrated in FIG. 2. That is, in this embodiment, the electronic components mounted on the first circuit board 400 and the electrical component box 700 provided for noise suppression are used as the restricting member.

As illustrated in FIGS. 9A and 9B, the restricting plate 700*a*3 is arranged at a position adjacent to the wall 300*a*3 of the housing 300*a* of the receptacle connector 300 in the direction of Arrow Y. A length of the restricting plate 700*a*3 in the direction of Arrow Z is longer than the length of the pin terminal 300*b* in the direction of Arrow Z. The electrolytic capacitor 600 is arranged at a position adjacent to the wall 300*a*4 of the housing 300*a* of the receptacle connector 300 in the direction of Arrow Y. A length of the electrolytic capacitor 600 in the direction of Arrow Z is longer than the length of the pin terminal 300*b* in the direction of Arrow Z.

Here, in the direction of Arrow Z, the length of the wall 300*a*3 of the housing 300*a* of the receptacle connector 300 is K1, the length of the wall 300*a*4 is K2, the length of the restricting plate 700*a*3 is K3, and the length of the electrolytic capacitor 600 is K4. The lengths K1 and K2 of the walls 300*a*3 and 300*a*4 of the housing 300*a* here refer to lengths of portions of the wall 300*a*3 and the wall 300*a*4 having the longest length in the direction of Arrow Z, respectively. Further, in the direction of Arrow Y, a distance between the wall 300*a*3 of the housing 300*a* and the restricting plate 700*a*3 is K5, and a distance between the wall 300*a*4 of the housing 300*a* and the electrolytic capacitor 600 is K6. A limit inclination angle, which is the insertion angle at which a proper electrical connection between the plug connector 200 and the receptacle connector 300 is guaranteed when the insertion angle of the plug connector 200 is obliquely inserted into the receptacle connector 300 from the direction of Arrow Y, is a limit angle θ2. Here, K1 to K6 and θ2 satisfy the following Conditions 4 and 5.

$$K5 \leq (K3-K1)/\tan(90-\theta 2)^\circ \quad \text{(Condition 4)}$$

$$K6 \leq (K4-K2)/\tan(90-\theta 2)^\circ \quad \text{(Condition 5)}$$

With such a configuration, when the operator attempts to insert the plug connector 200 into the receptacle connector 300 obliquely at an angle larger than the limit angle θ2, the restricting plate 700*a*3 or the electrolytic capacitor 600 abuts on the plug connector 200 to hinder the insertion. Further, when the operator attempts to pull out the plug connector 200 from the receptacle connector 300 obliquely at an angle larger than the limit angle θ2, the restricting plate 700*a*2 or the electrolytic capacitor 600 abuts on the plug connector 200 to hinder the pulling. That is, the insertion/removal angle of the plug connector 200 with respect to the receptacle connector 300 is restricted to be in a normal range by the restricting plate 700*a*2 or the electrolytic capacitor 600. Therefore, the deformation of the pin terminal 300*b* of the receptacle connector 300 is suppressed, and the stable electrical connection between the plug connector 200 and the receptacle connector 300 can be made.

Here, in the present embodiment, the limit angle θ2 at the time of the insertion of the plug connector 200 is assumed to be 25°, and more preferably 15°. Further, when mounting the receptacle connector 300, the length K1 of the wall 300*a*3 and the length K2 of the wall 300*a*4 of the housing 300*a* are determined in advance according to the specifications. In many cases, the length of the wall 300*a*3 satisfies 4 mm≤K1≤20 mm, and the length of the wall 300*a*4 satisfies 4 mm≤K2≤20 mm. Further, the length of the wall 700*a* of the electrical component box 700 is determined in advance. Considering the overall size of the image forming apparatus A, the length approximately satisfies 10 mm≤K3≤50 mm. The length K4 of the electrolytic capacitor 600 is determined in advance according to the specification, and approximately satisfies 10 mm≤K4≤25 mm. In this case, when mounting the receptacle connector 300 or attaching the first circuit board 400 on which the receptacle connector 300 is mounted to the image forming apparatus A, the distances K5 and K6 are set so as to satisfy the following Conditions 6 and 7.

$$K5 \leq (K3-K1)/\tan 65^\circ \quad \text{(Condition 6)}$$

$$K6 \leq (K4-K2)/\tan 65^\circ \quad \text{(Condition 7)}$$

In a case where the size of the electrical component box 700 can be selected, the length K3 of the restricting plate 700*a*3 can be set arbitrarily. In a case where the specification of the electrolytic capacitor 600 can be selected, the length K4 of the electrolytic capacitor 600 can be set arbitrarily. Further, in a case where the distances K5 and K6 are excessively long, it is difficult to restrict the insertion angle of the plug connector 200 even in a case where the length K3 of the restricting plate 700*a*3 or the length K4 of the electrolytic capacitor 600 is long. Therefore, it is desirable that 1 mm≤K5≤25 mm or 1 mm≤K6≤15 mm. The length K3 of the restricting plate 700*a*3 and the length K4 of the electrolytic capacitor 600 are set so as to satisfy the following Conditions 8 and 9.

$$K3 \geq K5 \tan 65^\circ + K1 \quad \text{(Condition 8)}$$

$$K4 \geq K6 \tan 65^\circ + K2 \quad \text{(Condition 9)}$$

As such, K1 to K6 are set so as to satisfy Conditions 8 and 9. As a result, even in a case where the plug connector 200 is inserted obliquely from the direction of Arrow Y, the insertion angle can be suppressed to 25° or less, which is the limit angle θ2. Therefore, the deformation of the pin terminal 300*b* of the receptacle connector 300 is suppressed, and the stable electrical connection between the plug connector 200 and the receptacle connector 300 can be made.

In the present embodiment, the entire wall 300*a*3 of the receptacle connector 300 and the restricting plate 700*a*3 overlap each other when viewed from the direction of Arrow Y. However, the present invention is not limited thereto, and the above effects can be obtained as long as at least a part of the wall 300*a*3 and the restricting plate 700*a*3 overlap each other when viewed from the direction of Arrow X. In addition, the above-described effect can be obtained as long as at least a part of the wall 300*a*4 and the electrolytic capacitor 600 overlap each other when viewed from the direction of Arrow Y.

In the present embodiment, a part of the wall of the electrical component box 700 or the electrolytic capacitor 600 mounted on the first circuit board 400 is used as the restricting member, but the present invention is not limited thereto. That is, instead of the restricting plate 700*a*2, the restricting plate 700*a*3, and the electrolytic capacitor 600, another electronic component mounted on the first circuit board 400 may be used as the restricting member. Further, instead of the restricting plate 700*a*2, the restricting plate 700*a*3, and the electrolytic capacitor 600, another member may be provided as the restricting member near the mounting surface 400*a* of the first circuit board 400 or near the first circuit board 400. Examples of the restricting member provided on the mounting surface 400*a* of the first circuit board 400 can include a wire saddle that restrains the cable 230. Even with such a configuration, the same effect as described above can be obtained.

<Arrangement of Receptacle Connectors>

Next, the arrangement of the receptacle connectors 300 to 305 will be described.

Figures 10A, 10B:
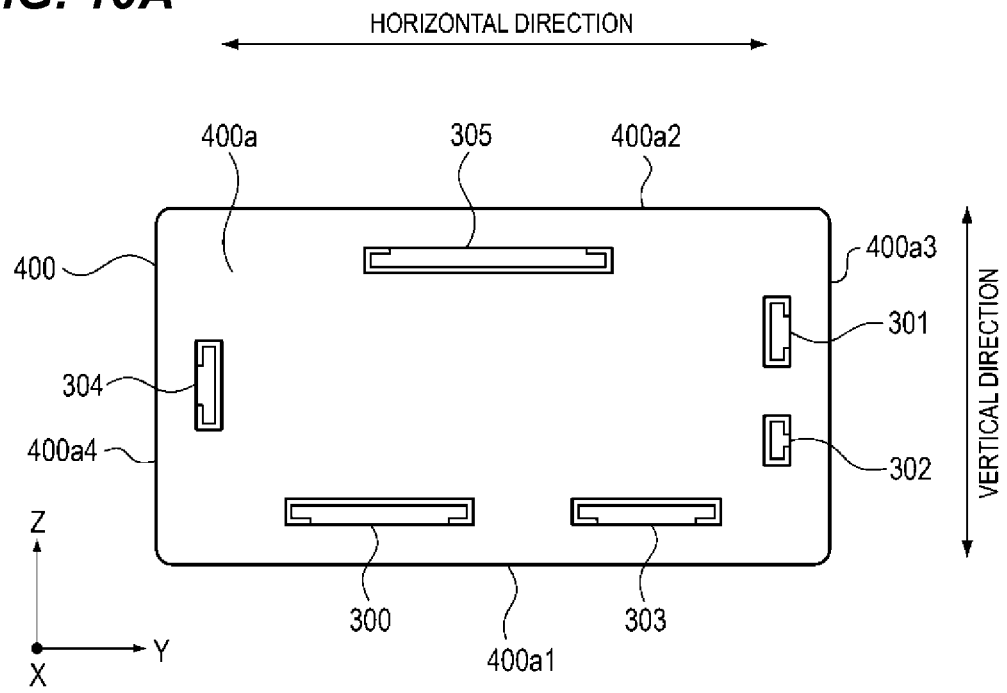
FIGS. 10A and 10B are a view illustrating arrangement of receptacle connectors, and a table showing specifications of the receptacle connectors, respectively.

FIG. 10A is a view illustrating arrangement of the receptacle connectors 300 to 305. Here, FIG. 10A is a view of the first circuit board 400 fixed to the stays 101 and 102, which are the frames of the image forming apparatus A, via the electrical component box 700 when viewed from the front. Here, a top-bottom direction indicates a vertical direction, and a left-right direction indicates a horizontal direction. FIG. 10B is a table showing lengths of the receptacle connectors 300 to 305 in a longitudinal direction, the number of pins of the pin terminal 300*b*, and the number of the engagement holes 300*c*1. Here, the longitudinal direction of the receptacle connectors 300 to 305 is the lateral direction of the pin terminal.

As illustrated in FIG. 10A, the mounting surface 400*a* of the first circuit board 400 has a side 400*a*1 (first side) which forms an end portion of the mounting surface 400*a* and extends in the horizontal direction, and a side 400*a*2 (third side) which is opposite to the side 400*a*1 and extends in parallel to the side 400*a*1. The mounting surface 400*a* has a side 400*a*3 (second side) which forms an end portion of the mounting surface 400*a* and extends in the vertical direction, and a side 400*a*4 (fourth side) which is opposite to the side 400*a*3 and extends in parallel to the side 400*a*3.

Here, in a case of arranging a receptacle connector, of which a pin terminal includes a large number of pins and a length in a longitudinal direction is large, on the mounting surface 400*a* so that the longitudinal direction is aligned with the vertical direction, the operator inserts a plug connector by gripping the plug connector so that a longitudinal direction of the plug connector is aligned with the vertical direction. In a case where the plug connector is gripped as described above, visibility of both end portions of the receptacle connector in the longitudinal direction deteriorates, and the wrist is difficult to maintain the insertion angle of the plug connector with respect to the receptacle connector. Therefore, it becomes easy for the plug connector to be inserted into the receptacle connector obliquely with respect to a direction orthogonal to the mounting surface 400*a* of the first circuit board 400. In particular, in a case of a receptacle connector having a long length in the longitudinal direction and having a plurality of engagement holes, it is conceivable that the operator may sequentially fit protrusion portions of the plug connector into the engagement holes one by one. Therefore, it becomes easy for the plug connector to be inserted obliquely with respect to the direction orthogonal to the mounting surface 400*a* of the first circuit board 400.

In this regard, in the present embodiment, the receptacle connectors 300, 303, and 305 each of which the pin terminal includes 15 or more pins are arranged so that the longitudinal directions thereof are aligned with the horizontal direction in which the sides 400*a*1 and 400*a*2 extend. Specifically, the receptacle connector 300 is mounted around the side 400*a*1 of the mounting surface 400*a* of the first circuit board 400, and is arranged so that the longitudinal direction thereof is aligned with the direction in which the side 400*a*1 extends. The receptacle connector 303 is mounted on the mounting surface 400*a* of the first circuit board 400 at a position adjacent to the receptacle connector 300 in the direction in which the side 400*a*1 extends, and is arranged so that the longitudinal direction thereof is aligned with the direction in which the side 400*a*1 extends. The receptacle connector 305 is mounted around the side 400*a*2 of the mounting surface 400*a* of the first circuit board 400, and is arranged so that the longitudinal direction thereof is aligned with a direction in which the side 400*a*2 extends. These receptacle connectors 300, 303, and 305 are receptacle connectors each having a length of 20 mm or more in the longitudinal direction, and are also plug connectors each having a plurality of engagement holes. In the present embodiment, the receptacle connectors 300, 303, and 305 are arranged so that the longitudinal directions of the receptacle connectors 300, 303, and 305 and the horizontal direction in which the sides 400*a*1 and 400*a*2 extend are parallel to each other, but the longitudinal directions and the horizontal direction may be shifted within a tolerance range.

Further, the receptacle connectors 301, 302, and 304 each of which the pin terminal includes 2 or more and less than 15 pins are arranged so that the longitudinal directions thereof are aligned with the vertical direction in which the sides 400*a*3 and 400*a*4 extend. Specifically, the receptacle connector 301 is mounted around the side 400*a*3 of the mounting surface 400*a* of the first circuit board 400, and is arranged so that the longitudinal direction thereof is aligned with the direction in which the side 400*a*3 extends. The receptacle connector 302 is mounted on the mounting surface 400*a* of the first circuit board 400 at a position adjacent to the receptacle connector 301 in the direction in which the side 400*a*3 extends, and is arranged so that the longitudinal direction thereof is aligned with the direction in which the side 400*a*3 extends. The receptacle connector 304 is mounted around the side 400*a*4 of the mounting surface 400*a* of the first circuit board 400, and is arranged so that the longitudinal direction thereof is aligned with a direction in which the side 400*a*4 extends. These receptacle connectors 301, 302, and 304 are receptacle connectors each having a length of less than 20 mm in the longitudinal direction, and are also plug connectors each having one engagement hole. In the present embodiment, the receptacle connectors 301, 302, and 304 are arranged so that the longitudinal directions of the receptacle connectors 301, 302, and 304 and the horizontal direction in which the sides 400*a*3 and 400*a*4 extend are parallel to each other, but the longitudinal directions and the horizontal direction may be shifted within a tolerance range.

As the receptacle connectors 300 to 305 are arranged as described above, it is possible to suppress the plug connector from being inserted into the receptacle connector obliquely with respect to the direction orthogonal to the mounting surface 400*a* of the first circuit board 400. As a result, the deformation of the pin terminals of the receptacle connectors 300 to 305 or the terminals of the plug connectors inserted thereinto is suppressed, and the stable electrical connection between the plug connectors and the receptacle connectors can be made.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2019-118654, filed Jun. 26, 2019, which is hereby incorporated by reference herein in its entirety.

What is claimed is:

1. An image forming apparatus comprising:

a first circuit board which is arranged on a rear side of the image forming apparatus;

a second circuit board which is electrically connected to the first circuit board via a cable;

a board-side connector which is mounted on the first circuit board, is connected to a cable-side connector of the cable, the board-side connector including a plurality of terminals extending in a first direction orthogonal to a mounting surface of the first circuit board and arranged in parallel in a second direction orthogonal to the first direction, and a housing in which the plurality of terminals is housed, the housing having a first wall arranged on one side of the plurality of terminals in a third direction orthogonal to the first direction and the second direction and having a portion of which a length in the first direction is larger than a length of each of the plurality of terminals in the first direction, the portion facing the plurality of terminals, the housing having a second wall arranged on the other side of the plurality of terminals and having a portion of which at least a part has a length in the first direction smaller than the length of each of the plurality of terminals in the first direction, the portion facing the plurality of terminals; and a restricting member configured to restrict an insertion angle of the cable-side connector with respect to the board-side connector, the restricting member being arranged adjacent to the second wall of the board-side connector in the third direction, a length of the restricting member in the first direction being larger than the length of each of the plurality of terminals in the first direction, wherein $L3 \leq (L2-L1)/\tan 65°$ is satisfied when the length of each of the plurality of terminals in the first direction is L1, the length of the restricting member in the first direction is L2, a distance between the plurality of terminals and the restricting member in the third direction is L3, and $L2 \leq 50$ mm.

2. The image forming apparatus according to claim 1, further comprising a metal housing member which houses the first circuit board, wherein the restricting member is a part of a wall of the housing member.

3. The image forming apparatus according to claim 1, wherein the restricting member is an electronic component mounted on the first circuit board.

4. The image forming apparatus according to claim 1, wherein the restricting member is a wire saddle that restrains the cable.

5. The image forming apparatus according to claim 1, wherein the board-side connector has an engaged portion, and the cable-side connector has an engaging portion that engages with the engaged portion and restricts movement of the cable-side connector connected to the board-side connector in the first direction.

6. An image forming apparatus comprising:

a first circuit board which is arranged on a rear side of the image forming apparatus;

a second circuit board which is electrically connected to the first circuit board via a cable;

a board-side connector which is mounted on the first circuit board, is connected to a cable-side connector of the cable, the board-side connector including a plurality of terminals extending in a first direction orthogonal to a mounting surface of the first circuit board and arranged in parallel in a second direction orthogonal to the first direction, and a housing in which the plurality of terminals is housed, the housing having a first wall arranged on one side of the plurality of terminals in a third direction orthogonal to the first direction and the second direction and having a portion of which a length in the first direction is larger than a length of each of the plurality of terminals in the first direction, the portion facing the plurality of terminals, the housing having a second wall arranged on the other side of the plurality of terminals and having a portion of which at least a part has a length in the first direction smaller than the length of each of the plurality of terminals in the first direction, the portion facing the plurality of terminals; and a restricting member configured to restrict an insertion angle of the cable-side connector with respect to the board-side connector, the restricting member being arranged adjacent to the second wall of the board-side connector in the third direction, a length of the restricting member in the first direction being larger than the length of each of the plurality of terminals in the first direction, wherein $L2 \geq L3 \tan 65° + L1$ is satisfied when the length of each of the plurality of terminals in the first direction is L1, the length of the restricting member in the first direction is L2, a distance between the plurality of terminals and the restricting member in the third direction is L3, and $L3 \leq 25$ mm.

7. The image forming apparatus according to claim 6, further comprising a metal housing member which houses the first circuit board, wherein the restricting member is a part of a wall of the housing member.

8. The image forming apparatus according to claim 6, wherein the restricting member is an electronic component mounted on the first circuit board.

9. The image forming apparatus according to claim 6, wherein the restricting member is a wire saddle that restrains the cable.

10. The image forming apparatus according to claim 6, wherein the board-side connector has an engaged portion, and the cable-side connector has an engaging portion that engages with the engaged portion and restricts movement of the cable-side connector connected to the board-side connector in the first direction.

11. An image forming apparatus comprising:

a circuit board which is arranged on a rear side of the image forming apparatus;

a board-side connector which is mounted on the circuit board, is connected to a cable-side connector of the cable, the board-side connector including a plurality of terminals extending in a first direction orthogonal to a mounting surface of the circuit board and arranged in parallel in a second direction orthogonal to the first direction, and a housing in which the plurality of terminals is housed, the housing having a first wall arranged on one side of the plurality of terminals in a third direction orthogonal to the first direction and the second direction and having a portion of which a length in the first direction is larger than a length of each of the plurality of terminals in the first direction, the portion facing the plurality of terminals, the housing having a second wall arranged on the other side of the plurality of terminals and having a portion of which at least a part has a length in the first direction smaller than the length of each of the plurality of terminals in the first direction, the portion facing the plurality of terminals; and a metal housing member which houses the circuit board, wherein the housing member includes a wall surrounding the circuit board, and the wall of the housing member extending to the first direction, wherein $L3 \leq (L2-L1)/\tan 65°$ is satisfied when the length of each of the plurality of terminals in the first direction is L1, the length of the wall of the housing member in the first direction is L2, a distance between the plurality of terminals and the wall of the housing member in the third direction is L3, and $L2 < 50$ mm.

* * * * *